US005421517A

United States Patent [19]

Knudson et al.

[11] Patent Number: 5,421,517

[45] Date of Patent: Jun. 6, 1995

[54] HIGH PRESSURE WATERJET NOZZLE

[75] Inventors: Jeffrey R. Knudson, Hazel Green; Thomas H. Bunch, Huntsville, both of Ala.

[73] Assignee: United Technologies Corporation, Hartford, Conn.

[21] Appl. No.: 922,590

[22] Filed: Jul. 30, 1992

[51] Int. Cl.[6] ..... B05B 3/02

[52] U.S. Cl. ..... 239/225.1; 239/561

[58] Field of Search ..... 239/553, 553.5, 561, 239/223, 224, 225.1, 561; 175/423, 424

[56] References Cited

U.S. PATENT DOCUMENTS

| | | | |
|---|---|---|---|
| 1,256,243 | 2/1918 | Maul | 239/561 X |
| 2,919,861 | 1/1960 | Meek | 239/561 X |
| 3,542,142 | 11/1970 | Hasiba | 175/424 X |
| 3,576,222 | 4/1971 | Acheson | 175/424 X |
| 3,881,561 | 5/1975 | Pols et al. | 175/424 X |
| 4,349,073 | 9/1982 | Zublin | 239/550 X |
| 4,733,735 | 3/1988 | Barr et al. | 175/424 X |
| 4,898,331 | 2/1990 | Hanson et al. | 239/223 |

*Primary Examiner*—Andres Kashnikow
*Assistant Examiner*—Kevin P. Weldon
*Attorney, Agent, or Firm*—Dominic J. Chiantera

[57] ABSTRACT

A rotating and translating waterjet nozzle uniformly strips the surface coatings from objects within the nozzle's swath through an array of orifices, each office having a sized hole diameter and a surface location on the nozzle which, collectively with the remaining orifices, provide a uniform stripping energy incident on the object surface.

16 Claims, 8 Drawing Sheets

SI2
60
58
68
46
X
66
48
0.0
0.50
1.0
Y
70
MAX Xo =0.88
36
38

HIGH PRESSURE WATERJET NOZZLE

TECHNICAL FIELD

This invention relates to waterjet nozzles, and more particularly to high pressure waterjet nozzles for use in removing coatings applied to substrate materials.

BACKGROUND ART

The overhaul and repair of gas turbine engines often requires the refurbishing of internal engine components. These engine elements are normally treated with various coatings including thermal barrier coatings, abradable seals, and hard facing. A commonly refurbished element is the high pressure compressor (HPC) casing. As known, gas turbine engines use an airseal around the engine's high pressure compressor blades to minimize the clearance between the compressor blade lips and the HPC casing. These seals, often referred to as "rubstrips", are abradable so that the blade tips may penetrate the surface without suffering tip damage. The seals comprise either a rubber material bonded to an amalgam of tungsten carbide and bond coat deposited on the casing, or a plasma sprayed abradable coating (typically nickel aluminide) applied over a bond coat to the outer airseal ring encircling the blades, which must be removed during engine refurbishment to allow refinishing of the HPC surface.

The bonded rubber/tungsten carbide seal is removed with scrapers, wire brushes, and wire wheels, and the plasma sprayed coating is removed by grit blasting, grinding or machining. The bond coats of either configuration are then removed chemically. Current requirements are to remove 90 percent of the rubstrip and bond coating during refurbishment.

Similiarly, scheduled aircraft maintenance may include removal of the aircraft's exterior paint coating due to paint deterioration, coating damage, coating buildup from touch-up painting, or the need to access bare aircraft surfaces to facilitate nondestructive inspection. These coatings, however, are highly adhering, durable paints which are formulated to protect the aircraft's external surfaces from corrosion and solid particulate erosion. They withstand extremes in temperatures, damage during unscheduled maintenance, and exposure to ultraviolet radiation. The inherent toughness and durability of these paint coatings make their removal difficult and expensive.

The aircraft industry, both commercial and military, presently removes organic coatings with methylene chloride-based chemical stripping compounds. This is followed by a mechanical abrasion to remove any coating residue. While chemical stripping is effective in removing paint from aircraft surfaces without damage to the surface metal, it does have several disadvantages, including: slow process time, expense, exposing workers to a hazardous environment, premature degradation of the working areas through the use of chemicals, and costly disposal techniques to minimize the environmental impact of the effluent.

A highly effective alternative to chemical and mechanical stripping is the use of high pressure water jets. This technique has been successfully used by USBI, Inc, a subsidiary of United Technologies Corporation, to remove coatings during refurbishing of space hardware under the National Administration and Space Agency's (NASA) Space Shuffle Program. USBI introduced automated, high pressure waterjet coatings removal in the refurbishment of the space shuttle's solid rocket boosters (SRBs) in the early 1980's. The waterjet stripping process is toxin free and allows for an enviornmentally safe proceedure in removing these coating materials. The process is also more effecient in terms of cost, higher removal rates, and less damage to the underlying substrate material.

The key element in these waterjet stripping systems is the waterjet nozzle. The nozzle must be capable of providing a uniform intensity jet to the target surface to ensure even removal of material in the nozzle's swath (path width) and to prevent substrate damage. The present waterjet nozzles, while effective, are not optimum in their performance in that the incident energy delivered to the target surface is not sufficiently uniform.

DISCLOSURE OF INVENTION

The object of the present invention is to provide a fluid-jet nozzle capable of uniformly stripping surface coatings from a target object.

According to the present invention a fluid-jet nozzle comprises a housing enclosing one or more manifolds in fluid communication with a housing connector adapted to engage source apparatus capable of providing displacement motive force and fluid flow to the nozzle, each such manifold further communicating with associated ones of a plurality of orifices disposed on a housing major surface, each orifice disposed at a different offset distances from the housing axis and each having a fluid passage diameter sized in dependence on its offset distance, whereby the nozzle, when such major surface is simultaneously rotated and translated by the source apparatus, at a standoff distance normal to the surface of a target object, provides a uniform stripping energy incident to the object's surface within the nozzle's swath.

In further accord with the present invention, such orifices as are located within a radially outward portion of such major surface provide a higher intensity fluid jet than those orifices located within a radially inward position on said surface. In still further accord with the present invention, such orifice array provides a spectrum of fluid intensity with an average value which increases in a geometric manner with offset distance from the housing axis.

The fluid nozzle of the present invention is characterized by a "balanced" orifice array in which each orifice's offset distance and diameter are selected in a manner which is interdependent with the offset and diameter of the remaining orifices in the array so as to impart a substantially uniform incident energy (IE) to a target surface positioned at a standoff distance normal to the array. This ensures uniform erosion of the target surface so as to remove surface coatings within the nozzle's swath without producing surface streaking or substrate damage. With the present invention's balanced orifice array the uniformity of the IE profile is maintained in the presence of excursions in the fluid pressure and flow, thereby establishing a nozzle tolerance to fluid fluctuations in the source apparatus.

These and other objects, features, and advantages of the present invention will become more apparent in fight of the following detailed description of a best mode embodiment thereof, as illustrated in the accompanying Drawing.

BEST MODE FOR CARRYING OUT THE INVENTION

Figure 1A:
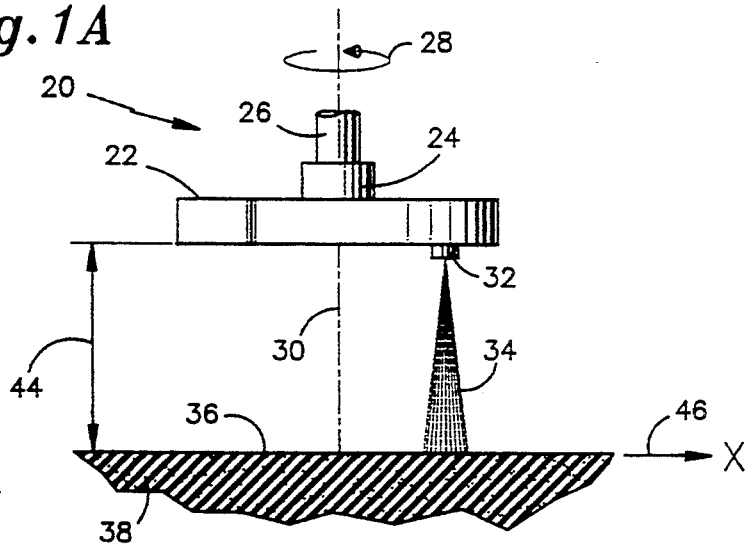
FIGS. 1 (A, B) are side elevation and bottom plan views, respectively, of a single orifice nozzle used in teaching the utility of the present invention.
Figure 1B:
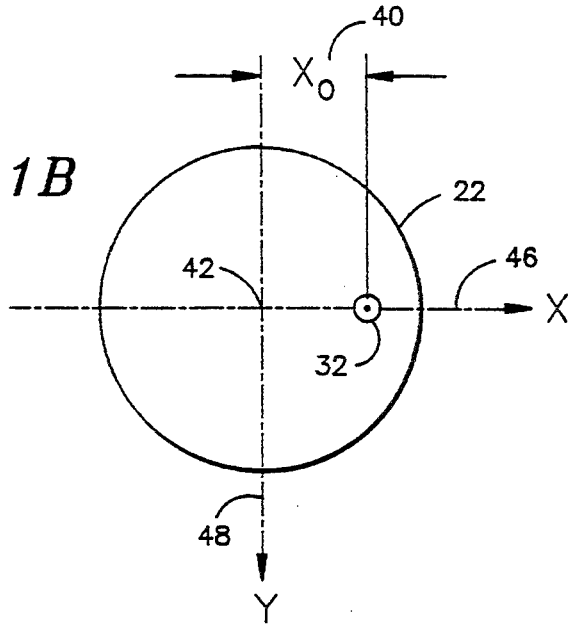

FIGS. 1A, 1B show side elevation and bottom plan views, respectively, of a simply illustrated prior art nozzle assembly 20. The assembly 20 includes a cylindrically shaped nozzle head 22 coupled through a shank portion 24 to a driveshaft 26 of the host system (not shown). The driveshaft rotates the head in a counterclockwise direction (as shown by the arrow 28) about the axis 30. The shaft also houses the conduit (not shown) which supplies high pressure water to the nozzle from the host system.

The FIG. 1 nozzle includes a single office 32 which provides a fluid jet 34 to a surface 36 of a target substrate 38. At the orifice the water jet has an "exit intensity" magnitude (flow and pressure) directly proportional to the magnitude of the supplied water pressure and the orifice diameter. The orifice 32 is positioned on the head at an "offset" distance ($X_o$) 40 from the nozzle's axial center 42 (the axis 30), and the nozzle head is spaced at a "standoff" distance 44 from the substrate surface 36.

To facilitate explanation of the nozzle's operation, the nozzle head 22 is assumed to be centered (FIG. 1B) at the origin of an X, Y Cartesian plane. In the illustrated embodiment the orifice 32 is located on the X axis 46, at the offset distance $X_o$ from the nozzle center 42. In operation, the nozzle simultaneously rotates about the nozzle axis 30 and translates along the plane's Y axis 48. It is assumed in the FIG. 1 embodiment that the translational speed of the nozzle is 1.0 inch per second (IPS) and the rotational velocity is 300–600 revolutions per minute (RPM) or 10 revolutions per second (RPS).

The "incident intensity" of the water jet 34 on the substrate surface 36 is a function of the jet's exit intensity and the nozzle's standoff distance 44. The jet's incident intensity on the surface, i.e. the "stripping intensity" (SI), is in the form of the standard normal density function:

$$SI_1[X] = \frac{1}{C_1} * e^{\frac{-(X-X0)^2}{C2}} \qquad \text{EQUATION 1}$$

where $SI_1$ is the stripping intensity magnitude, and $C_1$ and $C_2$ are constants. The magnitude of C1 is inversely proportional to the cube of the orifice diameter.

Figure 2A:
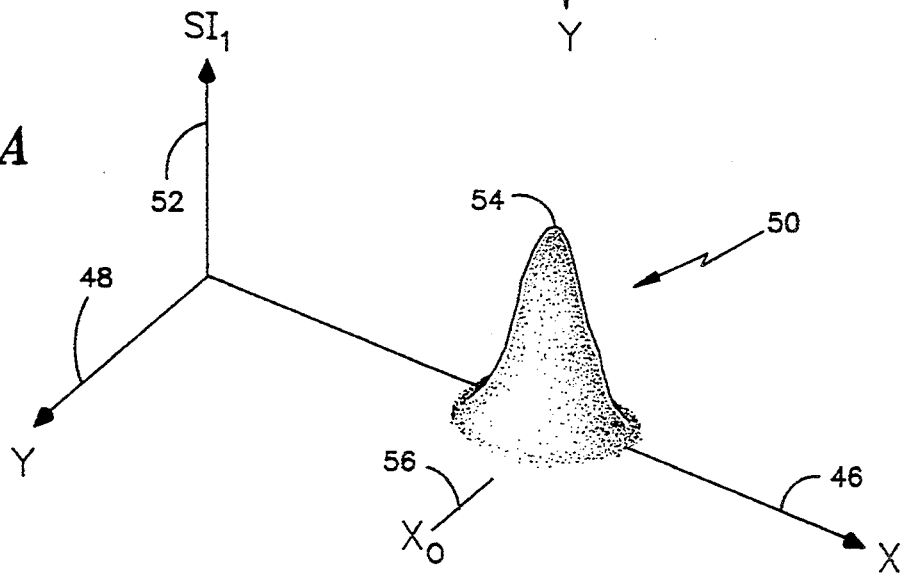
FIGS. 2 (A, B, C) are perspective illustrations of a performance characteristic of the nozzle embodiment of FIG. 1.

FIG. 2A is a perspective illustration, in a three axis Cartesian coordinate system, of the intensity distribution 50 of the jet at the surface 36 for a stationary nozzle. The substrate surface lies in the X, Y plane (46, 48) and the stripping intensity ($SI_1$) magnitude is in the SI plane 52. With the nozzle stationary, the fluid jet's peak intensity 54 is centered on the surface location 56, which corresponds with the orifice offset position ($X_o$, FIG. 1) on the nozzle.

Figure 2B:
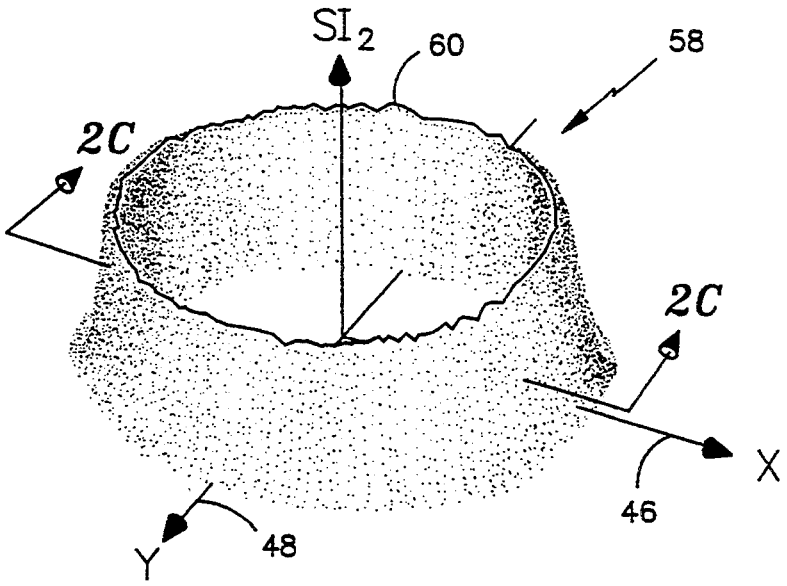

FIG. 2B illustrates the jet's surface stripping intensity distribution in the same coordinate system as the nozzle is rotated through the X, Y plane about the axis 30 (FIG. 1A), at zero translation velocity. The jet circulates about the nozzle axis to produce a stripping intensity volume ($SI_2$) in the form of a hollow cylinder 58, as defined by the equation:

$$SI_2[X, Y] = \frac{1}{C_1 N} * e^{\frac{-(\sqrt{X2-Y2}-X0)^2}{C2}} \qquad \text{EQUATION 2}$$

where $C_1$ and $C_2$ are the constants of Equation 1, $X_o$ is the orifice offset (40, FIG. 1B), and N is the area under the cylinder cross section (FIG. 2C) along the X axis 46, from X=0, Y=0 (the cylinder center 62) to $X=X_o+6$ sigma, Y=0, as defined by the equation:

$$N = \int_{X=0}^{X_0+6\sigma} 2\pi * SI_1[X] * dX = \int_{X=0}^{X_0+6\sigma} 2\pi * \frac{1}{C_1} * e^{\frac{-(X-X0)^2}{C2}} * dX \qquad \text{EQUATION 3}$$

Figure 2C:
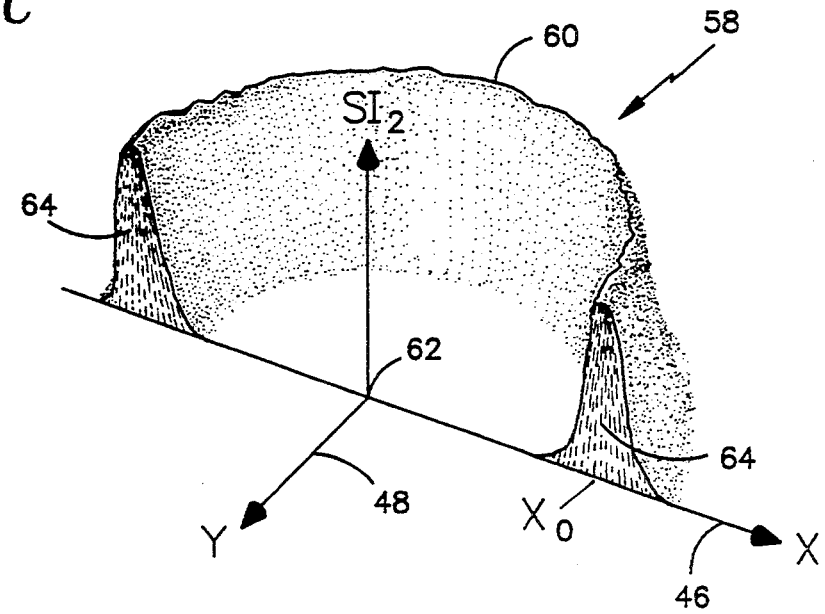

The cylindrical $SI_2$ pattern has an average peak amplitude 60 substantially equal to the peak amplitude 54 of the stationary distribution 50 in FIG. 2A, and a mean radius nominally equal to the orifice offset value $X_o$ 40. The FIG. 2C illustration, taken along the line 2C—2C of FIG. 2B, shows a zero $SI_2$ magnitude at the cylinder center 62 and a cylinder wall cross section 64 having a Gaussian distribution substantially identical to the distribution 50 of FIG. 2A.

The cylindrical $SI_2$ distribution 58, for a single orifice at nozzle zero translation, is also approximately correct for nominal rotational and translational rates of 10 RPS and 1.0 IPS, since the rotational speed is much greater than the translational rate (e.g. one revolution per 0.1 inch increment of translation). For purposes of this discussion we will assume that the density distribution 58 is also correct for a nozzle having 10 RPS rotation and 1.0 IPS translation.

Figure 3:
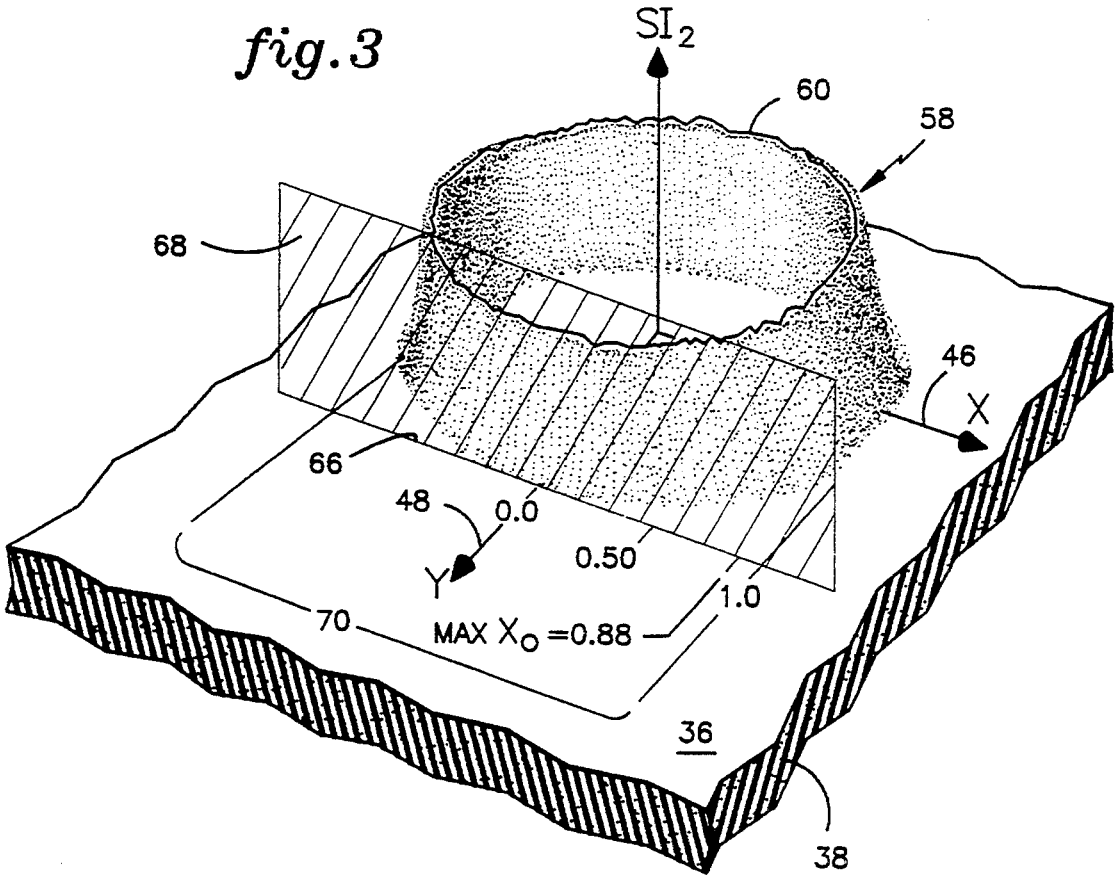
FIG. 3 is an alternative perspective illustration of the performance characteristic illustrated in FIG. 2, which is used in explaining the theory of operation of the nozzle embodiment of FIG. 1.

FIG. 3 illustrates the Y axis translation of the $SI_2$ distribution across a linear segment 66 of the substrate surface 36. The segment 66 lies at the base of the X-$SI_2$ plane 68, in the swath 70 of the translating nozzle. The $SI_2$ envelope propagates through the plane 68 as it crosses the segment at 1.0 IPS. If we assume an orifice offset $X_o$=0.880 inches, the mean diameter of the $SI_2$ envelope is approximately 1.81 inches and the translation time of the nozzle across the segment is greater than 18 seconds. At 10 RPS the nozzle achieves more than 180 revolutions in the same period.

The incident energy (IE) delivered to the surface segment is uneven due to the uneven nature of the $SI_2$ density distribution (i.e. the cylindrical pattern). This produces uneven erosive forces on the surface segment. Assume, for purposes of this discussion, that the total water energy delivered to the surface is equal to the volume under the $SI_2$ distribution 58. The IE magnitude may then be calculated as the surface integral of the $SI_2$ distribution along the Y axis (which simulates Y axis translation). The integral is expressed as:

$$IE[X] = \int_{Y=0}^{Y=\infty} SI_2[X, Y]*dY \qquad \text{EQUATION 4}$$

Substituting $SI_2$ (EQ. 2) in Equation 4:

$$IE[X] = \int_{Y=0}^{Y=\infty} \frac{1}{C_1 N} * e^{\frac{-(\sqrt{X2-Y2}-X0)2}{C2}} * dY \qquad \text{EQUATION 5}$$

Figure 4:
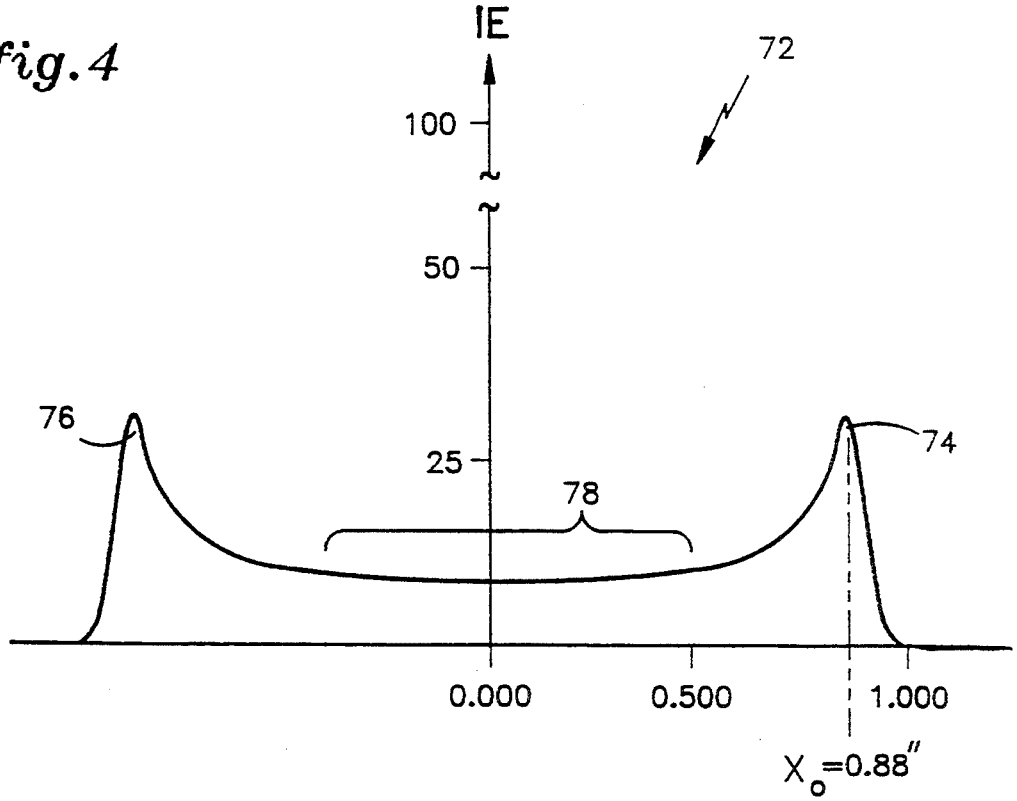
FIG. 4 is a waveform illustration which is used in conjunction with FIG. 3.

Waveform 72 of FIG. 4 is a qualitative illustration of the IE distribution along the portion of the segment 66 within the swath 70. The waveform traces the locus of surface integral values obtained with Equation 5. The X axis of the waveform is graduated in inch intervals equal to those shown along the surface segment 66 (at the base of the plane 68) in FIG. 3, to provide correlation between the IE waveform and the locations along the segment. The IE distribution is characterized by energy peaks 74, 76 at the extremities of the swath 70, parallel to the Y axis, and corresponding to the orifice offset ($X_o$=0.88 inch.); the location of the maximum $SI_2$ density. The low level energy (the shallow portion 78 of the waveform) corresponds to the minimum density portion of the distribution 58 (the central region). Simply visualized, the peaks are the surface integral of the "side walls" of the FIG. 3 distribution and the shallow portion is the integral of the front and back walls and the zero intensity center.

The single orifice IE profile creates uneven erosion of the substrate surface, which results in uneven removal of the surface coating. If the peak energy levels (74, 76) are capable of removing the surface coating than the low energy level 78 will be insufficient to remove the surface coatings. If the pressure is adjusted to ensure that the low energy level 78 is sufficient to remove the surface coatings than the peak values may deliver such severe surface erosion as to damage the substrate itself.

Figure 5:
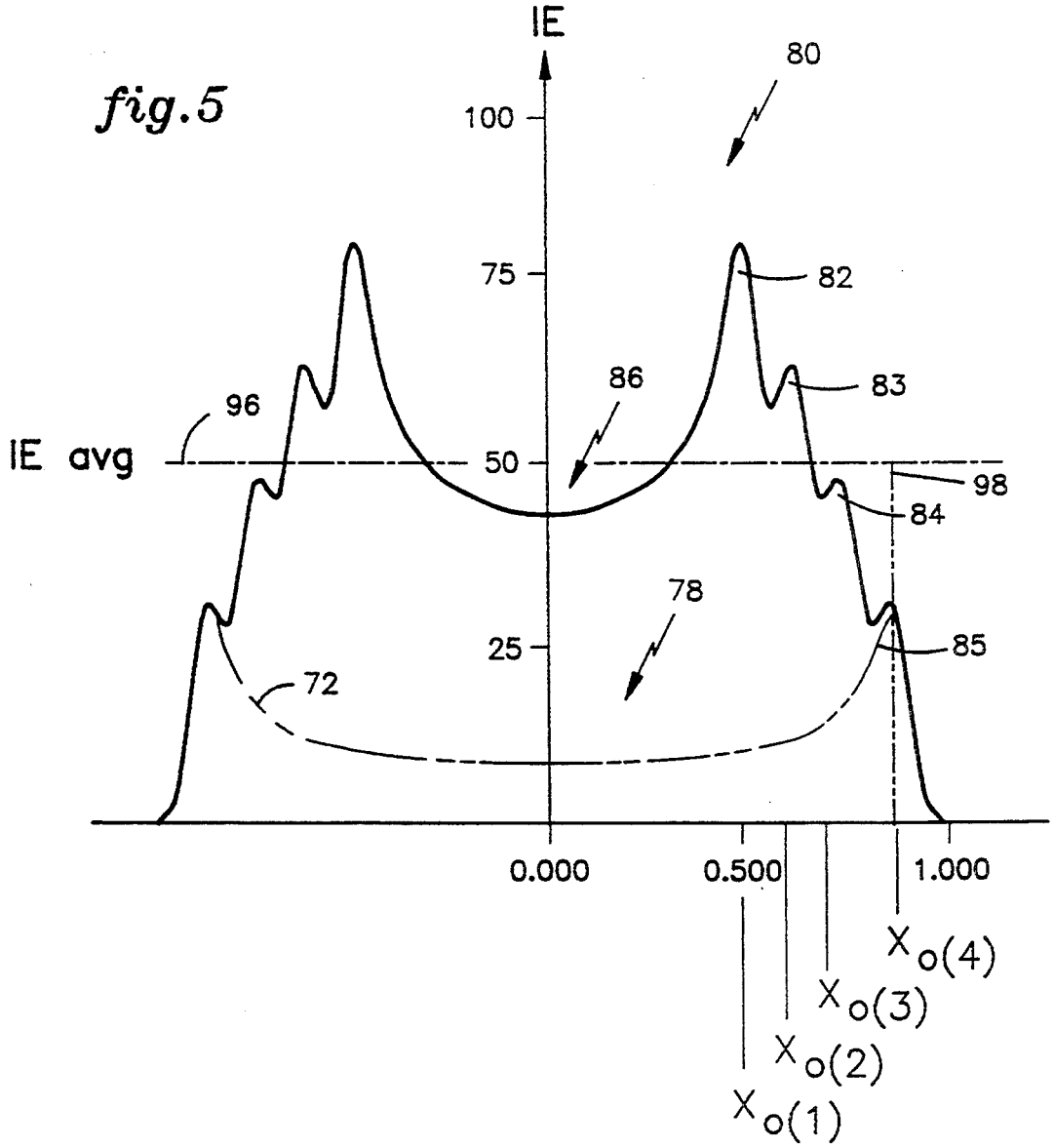
FIG. 5 is a waveform illustration which is used to explain the theory of operation of an alternative nozzle embodiment to that shown in FIG. 1.

It is known in the prior art to place additional orifices on the nozzle to mitigate the disparate energy profile created by the single orifice. The multiple orifices have equal diameters but are spaced at different $X_o$ offset values along the same or different radial axis of the nozzle. Waveform 80 of FIG. 5 is the sum incident energy provided by a nozzle having four equal diameter orifices with offset values of: $X_{o(1)}$=0.50 in., $X_{o(2)}$=0.63 in., $X_{o(3)}$=0.75 in., and $X_{o(4)}$=0.88 in. The total energy is the sum of the IE created by each nozzle, or:

$$IE[X]_{total} = \sum_{\text{orifice}=1}^{\text{orifice}=n} IE[X] \qquad \text{EQUATION 6}$$

with IE[X] for each orifice being defined by Equation 5. FIG. 5 also illustrates (in phantom) the IE waveform 72 (FIG. 4) for the single orifice ($X_o$=0.88 in.).

The sum IE energy profile for the four orifice nozzle is characterized by four peaks 82–85 which are spatially coincident with the orifice offsets $X_{o(1)}$–$X_{o(4)}$; in the same manner as the peak 74 of waveform 72 (FIG. 4) is coincident with the offset of the single orifice (32, FIGS. 1A,B). The waveform 80 also has a shallow energy level in the central portion 86 of the waveform, similar to the shallow characteristic 78 of the waveform 72. It is important to note, however, that the peak energy level produced by an orifice increases in amplitude as the orifice offset value decreases. e.g. the tallest peak 82 is produced by the orifice with the smallest offset ($X_{o(1)}$).

Figure 6:
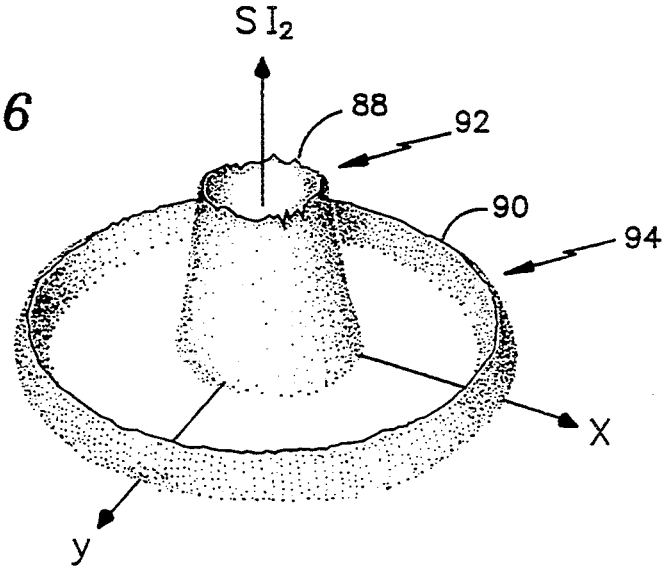
FIG. 6 is a perspective illustration of a performance characteristic of the alternative nozzle embodiment performance depicted in FIG. 5.

Equation 3 and FIG. 6 illustrate this point by comparison of the peak values 88, 90 for the $SI_2$ distributions 92, 94 of equal diameter orifices having offset values that differ by 100%. This can be seen from Equation 3, where a decrease in the offset $X_o$ decreases the value of N which, in Equation 2, increases the magnitude of $SI_2$. The higher peak amplitude for the smaller offset may also be intuitively obvious since both distributions 92, 94 have equal volume so that as the diameter decreases the amplitude must increase.

Although the waveforms 72 and 80 provide only a quantitative illustration of the respective IE profiles, they accurately illustrate the characteristic energy profile of the prior art nozzles. This characteristic includes the severe disparity in stripping intensity across the path of the rotating nozzle as it translates along the substrate surface. The shallow center energy level coupled with extreme peak energy pulses and, in the case of a multiple orifice nozzle, the saw tooth like edges. If the water supply pressure is adjusted to ensure that the energy level of the waveform central region 86 provides coating removal at the substrate surface, the stripping intensity of the lower energy peak 85 may be insufficient to remove the coating while the high intensity of the energy peak 82 can create substrate damage.

The average level of IE for the waveform 80 is identified by the dashed line 96, and is defined as:

$$IE[X]_{avg} = \frac{1}{\max X_0} * \int_{X=0}^{\max X_0} * \sum_{\text{orifice}=1}^{\text{orifice}=n} IE[X]*dX \qquad \text{EQUATION 7}$$

where max $X_o$ is the highest orifice offset value which, for the waveform 80 four nozzle embodiment, is marked by the dashed line 98 at $X_{o(4)}$.

The waveform deviation from average, i.e. the waveform ripple or ΔIE, is defined by the expression:

EQUATION 8

$$\Delta IE[X] = \int_{x=0}^{X=\max X_0} (IE[X]_{total} - IE[X]_{avg})^{2*} dX$$

ΔIE is a measure of the unevenness of the IE distribution which can be correlated empirically with the resulting surface roughness of the substrate following stripping. Ideally ΔIE would equal zero, with $IE[X]_{total} = IE[X]_{avg}$, in which case the IE profile would appear as the step function waveform 100 of FIG. 7, with an equal energy intensity plateau 102 across the width (max $X_o$) of the nozzle swath.

The fluid nozzles of the present invention have multiple orifices arrayed in a determined radial pattern, with different fluid passage diameters, to provide a nearly zero ripple profile. The present nozzles minimize ΔIE so as to provide a stripping intensity profile which approximates that of the ideal energy profile 100 creating a substantially uniform stripping intensity across the nozzle swath. As described in more detail hereinafter, the orifices are placed at increasingly greater radial offset distances from the nozzle's rotational axis. Each orifice has a fluid passage diameter value which is selected to provide each succeedingly greater offset orifice with the capability of discharging a fluid jet having a nominal stripping intensity magnitude which is no lesser in magnitude than the stripping intensity of each preceding lesser offset orifice. In other words, the orifice offset and diameter values are chosen such that the stripping intensities of successive orifices are generally increasing with orifice offset from the nozzle center.

Figure 8:
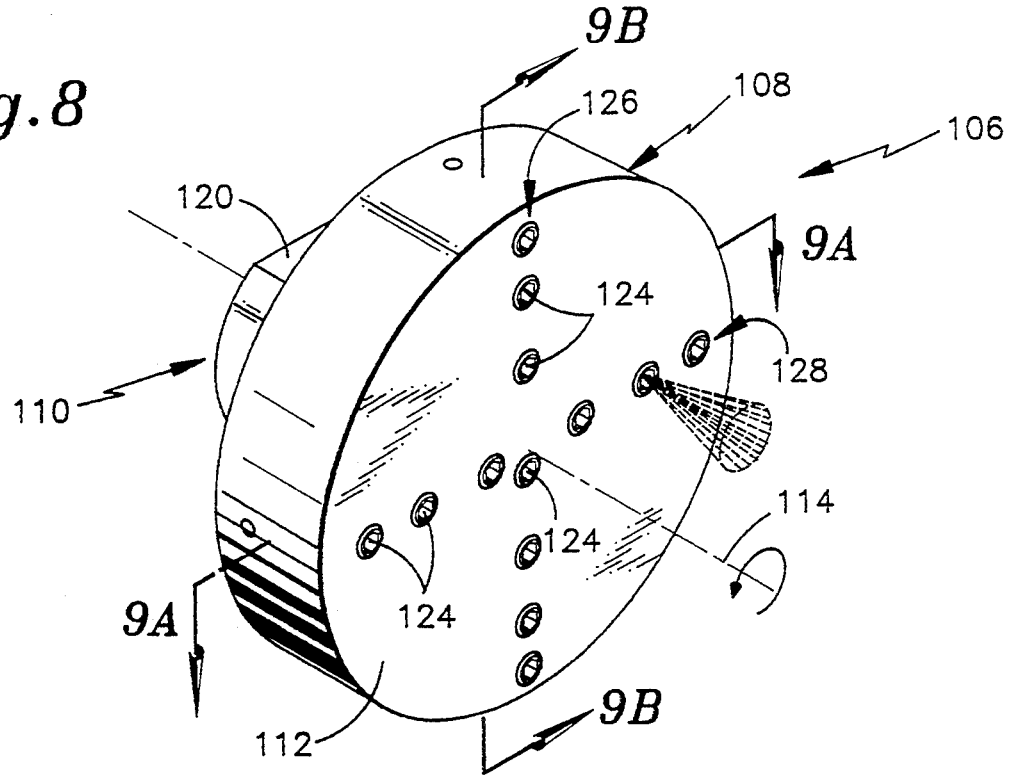
FIG. 8 is a perspective illustration of the best mode of an exemplary embodiment of a fluid nozzle according to the present invention.

FIG. 8 is a perspective illustration of the best mode of an exemplary embodiment of a fluid jet nozzle assembly 106 according to the present invention. The assembly 106 includes a single housing having a nozzle head portion 108 and a shank portion 110 (partially visible). Preferably, the housing is fabricated from corrosion resistant metal, such as 316 or 15-5 stainless steel, or any suitable equivalent known to those skilled in the art. The nozzle head 108 includes a major surface 112 positioned coaxial with the shank portion 110 about the nozzle's rotational axis 144.

The nozzle's rotational direction is preferably counter clockwise, as shown in FIG. 8, although clockwise rotation is also permitted. Similarly, in a best mode embodiment the nozzle head 108 and shank 110 are cylindrically shaped to facilitate rotational aerodynamics, however, it should be understood that any alternate aerodynamic shape may be used as deemed suitable by those skilled in the art.

Figure 9A:
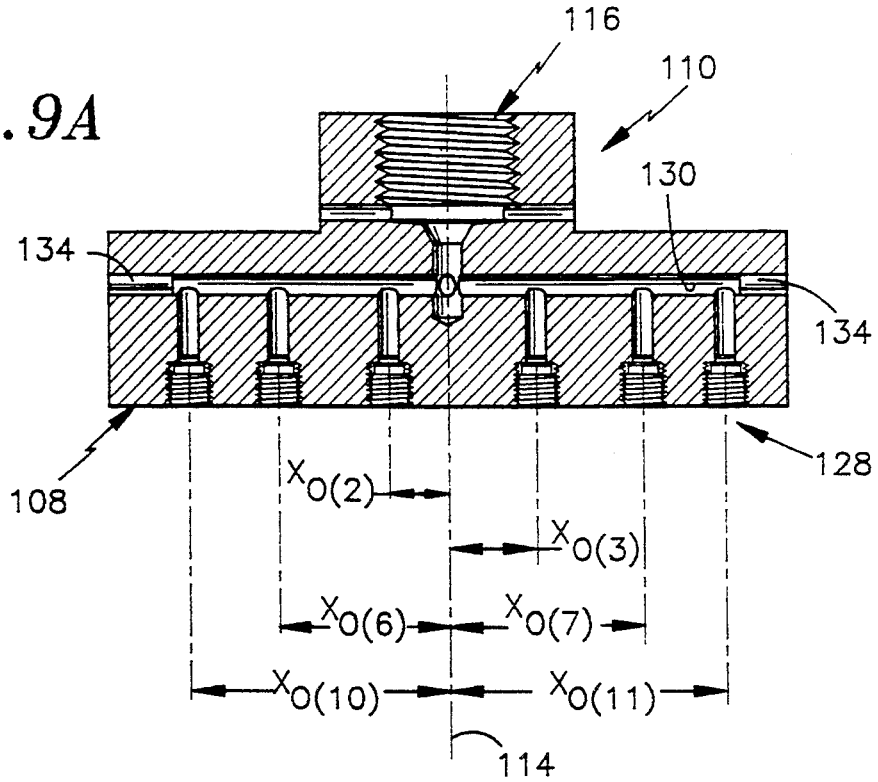
FIGS. 9 (A, B) are sectioned views taken along the lines 9A—9A and 9B—9B, respectively, of FIG. 8.
Figure 9B:
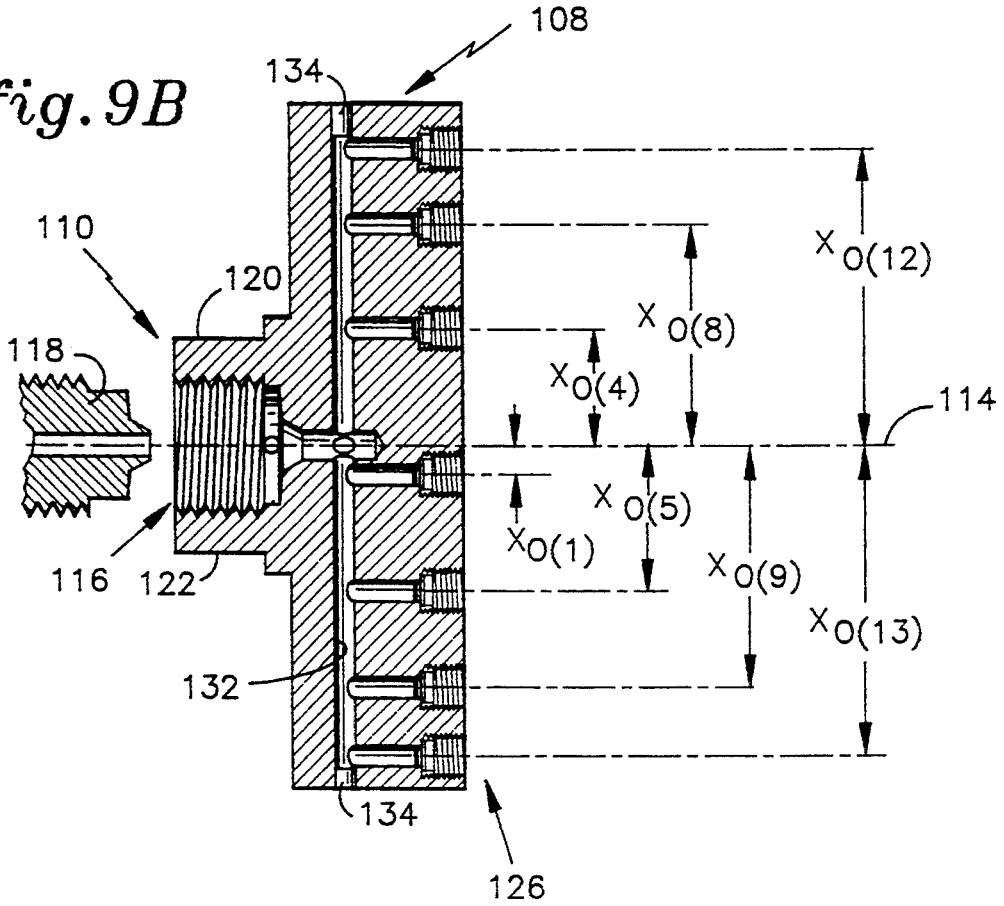

FIGS. 9A and 9B are sectioned views of the nozzle 106 taken along the lines 9A—9A and 9B—9B respectively. The shank portion 110 encloses a connector 116 which is adapted for threaded engagement with the shaft 118 of the host apparatus, which provides the nozzle's rotation/translation along the surface of the target object, as well as the source of pressurized fluid. To assist in securing the nozzle to the drive shaft 118, the cylindrical shank is truncated on two sides 120, 122 to provide gripping surfaces for a wrench. The threaded connector 116 is secured to the shaft 118 with up to 50 inch pounds of force.

In the present invention, the number of orifices in any given nozzle embodiment is selectable, and is determined by the permissible swath (path width) of the nozzle head across the target object surface to be stripped. Larger orifice arrays cover larger surface areas of the target object per unit time. As the number of orifices increase, however, the diameter of the nozzle head must also increase. Considerations governing the permissible head diameter include the increased mass and inertia of the rotating nozzle and the surface contour of the object surface to be stripped. Curved object surfaces necessarily require smaller diameter nozzles.

In the exemplary embodiment of FIG. 8 the nozzle has 13 orifices, shown generally at 124, which are arrayed on the nozzle's major surface 112. The 13 orifices are shown arrayed along two orthogonal radii 126, 128 of the nozzle head; each orifice being in fluid communication with an associated one of two manifolds, or passages 130 (FIG. 9A) and 132 (FIG. 9B) which are arranged within the housing along each radii. The actual number and arrangement of the passages is governed principally by the ease of manufacture. The number of orifices required for a given diameter nozzle usually prevent them from being positioned along a single radial, and rotation of the nozzle makes the lack of a single linear array immaterial to stripping performance. Other considerations include weight balance of the nozzle head.

TABLE I

| # | Offset (inches) | Diameter (inches) | # | Offset (inches) | Diameter (inches) |
|---|---|---|---|---|---|
| $X_{o(1)}$ | 0.150 | 0.008 | $X_{o(8)}$ | 1.300 | 0.012 |
| $X_{o(2)}$ | 0.350 | 0.008 | $X_{o(9)}$ | 1.400 | 0.014 |
| $X_{o(3)}$ | 0.500 | 0.010 | $X_{o(10)}$ | 1.550 | 0.014 |
| $X_{o(4)}$ | 0.700 | 0.010 | $X_{o(11)}$ | 1.650 | 0.016 |
| $X_{o(5)}$ | 0.900 | 0.010 | $X_{o(12)}$ | 1.750 | 0.016 |
| $X_{o(6)}$ | 1.000 | 0.012 | $X_{o(13)}$ | 1.800 | 0.018 |
| $X_{o(7)}$ | 1.150 | 0.012 | | | |

The outside diameter of the nozzle head 108 is four inches (OD=4.0 in., FIG. 9A). The orifices are radially displaced from the nozzle's rotational axis 114 in successively higher offset distances ($X_o$). The offset values for the thirteen orifices ($X_{o(1)}$ through $X_{o(13)}$) are listed in Table I. As shown, the incremental increase in offset distance between adjacent orifices ($\Delta X_o$) generally decreases with higher offset distances, such that the $\Delta X_o$ between the first two orifices ($X_{o(1)}$ and $X_{o(2)}$) is 0.150 inches while that between the highest two offset orifices ($X_{o(12)}$ and $X_{o(13)}$) is 0.050 inches.

Figure 10:
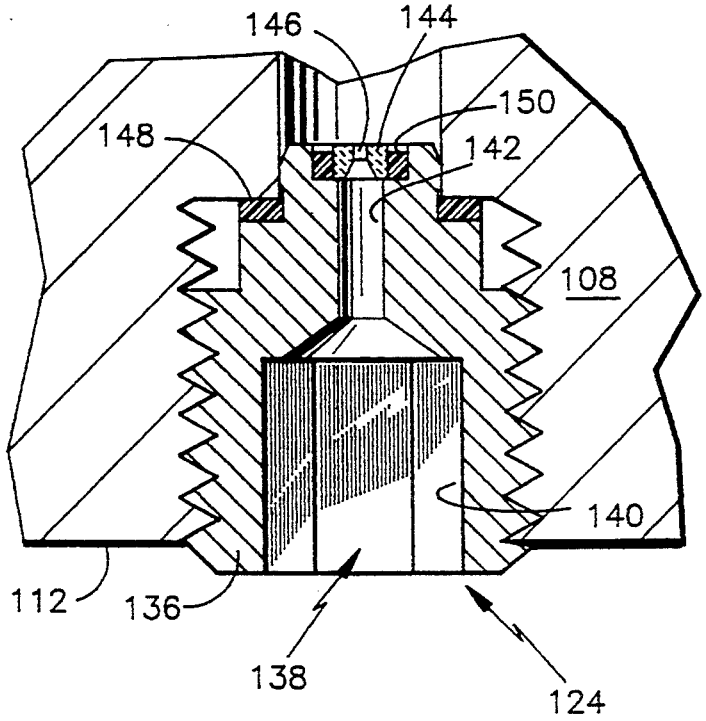
FIG. 10 is a sectioned view of one portion of the nozzle embodiment of FIG. 8.

The orifices are each seated in apertures bored in the nozzle head, in fluid communication with a related one of the manifolds 130, 132. As shown in FIGS. 9A, 9B, the apertures are threaded to permit threaded insert of the orifice therein. FIG. 10 illustrates a cross section of one of the orifices seated in its aperature. The orifice assembly includes a threaded metal housing 136; typically stainless steel. The housing includes a central bore 138 having several segments, including an outermost hexagonal cavity 140 which facilitates use of an Allen wrench to insert the orifice. The recessed end of the cavity 140 tapers to a channel 142 which tunnels through the orifice housing to the orifice valve assembly 144 with its controlled fluid aperture, or fluid passage diameter 146 which is located at the deepest recess of the orifice housing. The orifice valve is typically a crystalline structure, preferably sapphire. The orifice housing is sealed in its seat by seal 148 and the orifice valve 144 includes seal 150.

The point of novelty of the present invention is in an orifice array which is characterized by large incremental radial offset spacing and small orifice diameters at the center of the nozzle, to increasingly smaller incremental offsets and increasingly larger diameters at the edge. This produces a magnitude spectrum of individual orifice jet intensities characterized by a minimum intensity magnitude at the smallest radial offset location to a maximum intensity magnitude at the greatest offset site. This characteristic spectrum is common to all fluid nozzles embodying the present invention and it is this spectrum which during translation of the rotating nozzle head across the target produces a uniform IE to the target surface.

Figure 11:
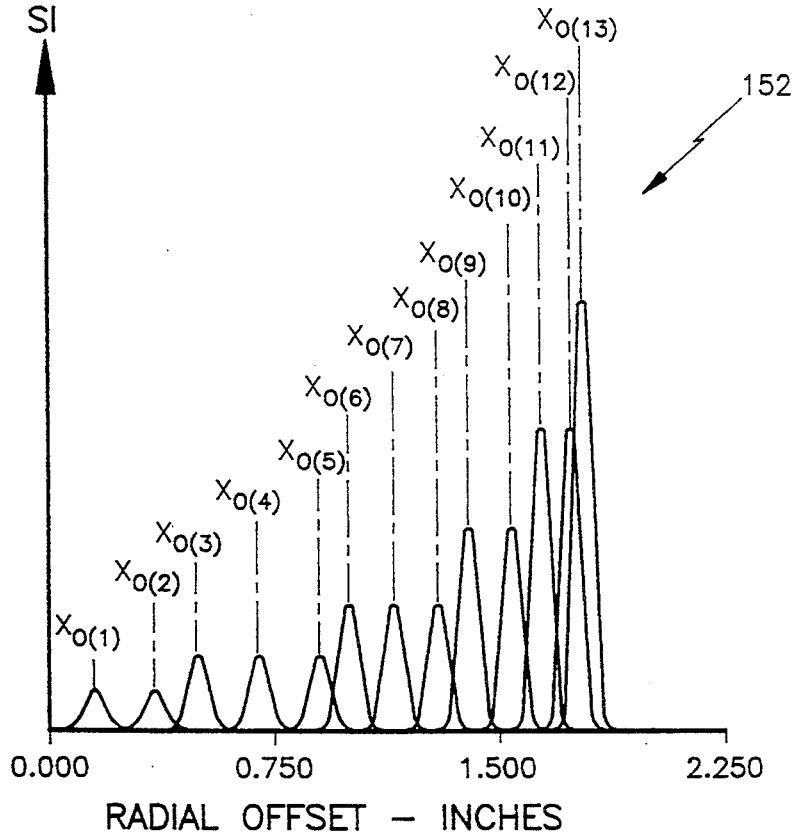
FIG. 11 is a waveform illustration used in the description of operation of the nozzle embodiment of FIG. 8.

In FIG. 11 the magnitude spectrum 152 is illustrated as a sequence of 13 individual intensity distributions; each having a normal distribution, plotted along an axis representing radial offset. The individual intensities are each shown centered at the corresponding radial offset values listed in Table I ($X_{o(1)}$–$X_{o(13)}$) for their associated orifice. The FIG. 11 illustration is only intended to provide a qualitative representation of the spectrum trend so that the Y axis, which represents stripping intensity magnitude, is dimensionless and intended only for relative comparison of individual intensity peaks. As may be seen, the spectrum intensity generally increases with increasing radial offset of the orifices. This is due to the increasing fluid passage diameters of the orifices as their radial offsets increase (see Table I).

Figure 7:
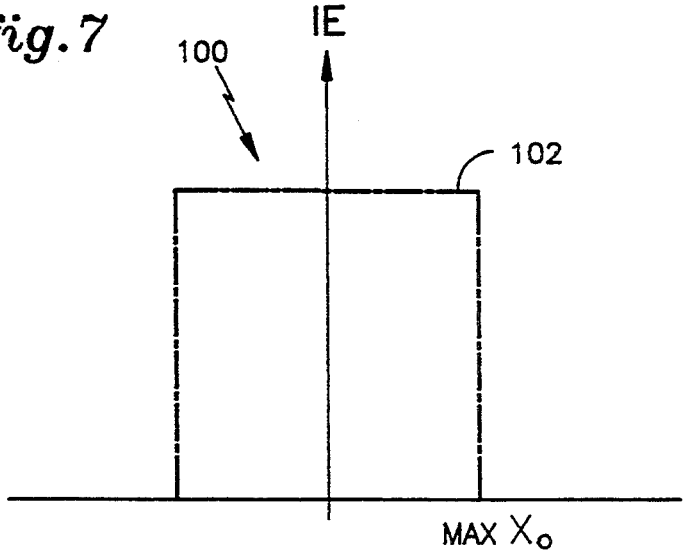
FIG. 7 is a waveform illustration which is used in conjunction with FIG. 5.

This static intensity (non-rotating nozzle) spectrum, from lesser intensity at lesser offset to greater intensity at greater offset, is necessary to produce the uniform IE profile which is idealized in FIG. 7. As described hereinbefore with respect to FIG. 6, the peak magnitude of the SI distribution of rotating orifices of equal diameter will be greater for the orifice with the lesser offset. With rotation, therefore, the lesser offset orifices will have higher SI peaks. For example, with rotation of the nozzle the peak SI value for the $X_{o(3)}$ offset orifice will be greater than that for the $X_{o(4)}$ offset orifice of equal diameter. This is reason for the static spectrum progression from lower to higher intensity with increasing offset.

Figure 12:
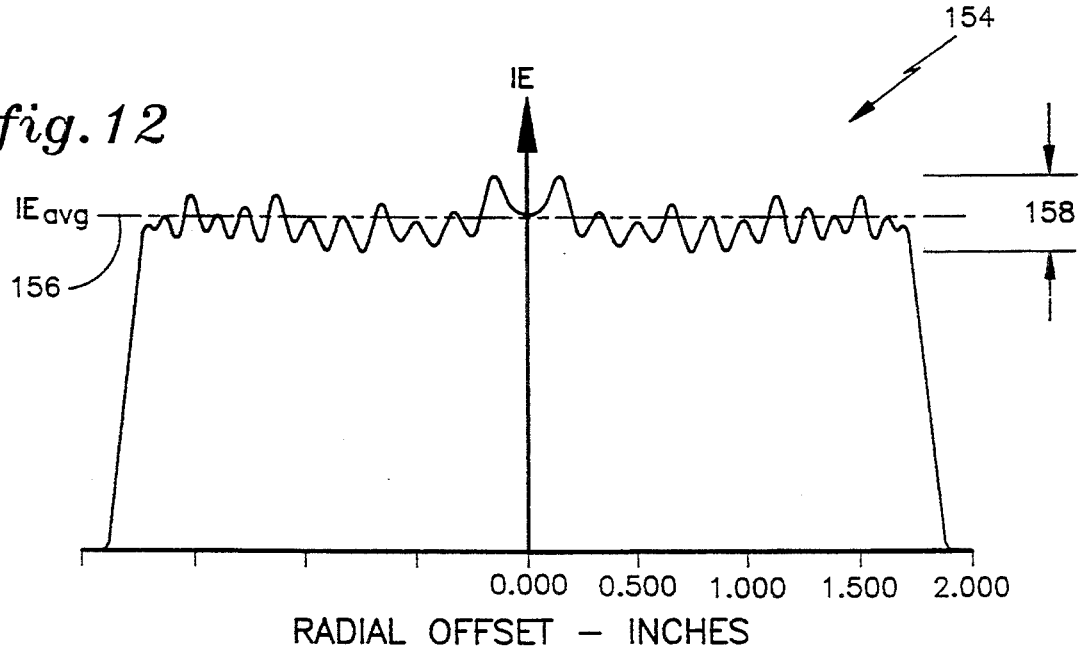
FIG. 12 is another waveform illustration used in the description of operation of the nozzle embodiment of FIG. 8.

The resulting IE profile corresponding to the FIG. 11 intensity spectrum is illustrated in FIG. 12 by the waveform 154. The IE waveform 154 has a ΔIE (Equation 8) which, as a qualitative percentage of $IE_{avg}$ 156, is less than 15%, compared to the ΔIE of the waveform 80 (FIG. 5) which is greater than 30%. For the waveform 154, the dither 158 percentage (the ripple peak-to-valley magnitude divided by the waveform peak value x 100%) is less than 20%, while that of waveform 80 is close to 50%. The IE dither has a direct correlation to the surface roughness of the target substrate following coating removal.

The IE dither may be further reduced with finer balancing of the static (non-rotating nozzle) intensity spectrum (FIG. 11). The intensity, spectrum of FIG. 11 is based on the use of commercially available orifice diameters which have fixed increments. If available, freer incremental diameter orifice values would allow the locus of the static intensity peaks of the intensity spectrum 152 to be curvilinear. Ideally, for absolute minimum IE dither, the peak intensities of the static spectrum 152 would increase for each succeedingly further offset orifice. Practical size constraints, however, prevent this. Furthermore, empirical results to date indicate that dither percentages of 20% or less provide little or no measurable or observable surface roughness following coating stripping.

The nozzles of the present invention may be used with pressurized fluid up to 55,000 PSI; the pressure limits are generally governed by the characteristics (durability) of the target object to be stripped. Similiarly nozzle rotational speeds of from 400 to 700 RPM have been used successfully, with translational speeds of from 1.0 to 3.0 IPS. A rotational speed range of 450 to 500 RPM and 1.0 IPS translational speed may be considered the nominal dynamics for the nozzle, however the broader range may be used as considered suitable for the particular target object material.

Although the invention had been shown and described with respect to a best mode embodiment thereof, it should be understood by those skilled in the art that various other changes, omissions, and additions may be made in the form and detail thereof without departing from the spirit and scope of the invention, as recited in the following claims.

We claim:

1. A nozzle, for use in a system having a source of pressurized fluid and a source of motive power for rotating and translating the nozzle along a nozzle trajectory at a standoff distance from a workpiece surface, for emitting pressurized fluid along the nozzle trajectory to remove surface coatings from a workpiece surface placed within the nozzle swath, the nozzle comprising:

a housing, having a first side connective means disposed coaxial with the rotational axis of said housing for engaging the system source of pressurized fluid and the system source of motive power, and having a plurality of apertures disposed on a distal side major surface, said housing enclosing one or more fluid passages disposed in fluid communication with said connective means and with said plurality of apertures, each aperture being adapted to receive a valve orifice; and a plurality of valve orifices, each having a fluid passage diameter and each disposed in fluid communication within a corresponding one of said apertures, for emitting a pressurized fluid jet therefrom at an exit jet intensity proportional to the value of said fluid passage diameter;

as characterized by:

each of said plurality of apertures being disposed at a different radial offset distance from said rotational axis, the maximum radial offset distance representing the radius of the nozzle swath; and each valve orifice having a fluid passage diameter value selected in dependence on the radial distance of its corresponding aperture to provide an exit fluid jet intensity which, in combination with the exit fluid jet intensities provided by the other of said orifices, provides a substantially uniform incident energy at the surface of the workpiece within the nozzle swath.

2. The nozzle of claim 1 wherein said fluid passages are linear.

3. The nozzle of claim 1, wherein said plurality of aperture is arrayed along one or more radial lines which intersect said rotational axis.

4. The nozzle of claim 1, wherein said housing comprises type 316 stainless steel.

5. The nozzle of claim 1, wherein said housing comprises type 15-5 stainless steel.

6. The nozzle of claim 1, wherein each of said orifices comprise sapphire crystal.

7. The nozzle of claim 1, wherein said connective means comprises a threaded compression fitting, recessed within said housing, and adapted to releasable engage the source of motive power.

8. The nozzle of claim 1, wherein said housing comprises a substantially cylindrical shape.

9. The nozzle of claim 1, wherein the said fluid passage diameter value of each said orifice is directly proportional to the magnitude of the radial offset distance of said corresponding aperture.

10. The nozzle of claim 1, wherein:

said apertures are successively positioned on said distal major surface at increasing radial offset distances from said rotational axis, each succeeding position aperture being spaced at an incremental offset distance from a preceding position aperture; and said valve orifice of each succeeding position aperture has a fluid passage diameter which is no less in value than the fluid passage diameter value of said valve orifice of each preceding position aperture.

11. The nozzle of claim 1, wherein:

said apertures are successively positioned on said distal major surface from a first aperture at a minimum radial offset distance to a last aperture at said maximum radial offset distance; and said valve orifice associated with said last aperture has a greater fluid passage diameter value than that of said valve orifice associated with said first aperture.

12. The nozzle of claim 1, wherein:

said apertures are successively positioned on said distal major surface from a first aperture at a minimum radial offset distance to a last aperture at said maximum radial offset distance; and said valve orifice associated with said last aperture emits said pressurized fluid at a greater magnitude fluid jet intensity than that of said valve orifice associated with said first aperture.

13. The nozzle of claim 1, wherein:

said plurality of apertures are positioned on said distal major surface at increasing radial offset distances from said rotational axis, from a first group of apertures positioned at lesser radial offset distances to a second group of apertures positioned at greater radial offset distances; and said valve orifices associated with said second group of apertures emit a greater magnitude average fluid jet intensity than those of said valve orifices associated with said first group of apertures.

14. The nozzle of claim 1, wherein:

each said fluid passage is disposed within said housing along an associated radii of said distal major surface; and said plurality of apertures are individually positioned on said distal major surface along a corresponding one of said associated radii at serially increasing radial offset distances from said rotational axis, each in fluid communication with said fluid passages.

15. The nozzle of claim 1, wherein:

said plurality of apertures are individually positioned along an associated radii of said distal major surface, each located at a radial offset distance different from that of other apertures positioned on the same or other radii, to provide an aperture array characterized by a serial progression of apertures increasing in radial offset position from a minimum radial position to a maximum radial position on said distal major surface; and said valve orifices collectively emit pressurized fluid at fluid jet intensities which increase in magnitude in substantial correspondence with said serial progression of aperture positions from said minimum radial position to said maximum radial position.

16. The nozzle of claim 1, wherein:

each said fluid passage is disposed within said housing along an associated radii of said distal major surface; and said plurality of apertures are positioned on said distal major surface at serially increasing radial offset distances from said rotational axis, each said aperture being in fluid communication with an associated one of said fluid passages.

* * * * *